United States Patent [19]

Varda

[11] 4,142,751

[45] Mar. 6, 1979

[54] DOOR LOCKING MECHANISMS FOR HOPPERS

[75] Inventor: Eugene I. Varda, Saint John, Ind.

[73] Assignee: Pullman Incorporated, Chicago, Ill.

[21] Appl. No.: 858,778

[22] Filed: Dec. 8, 1977

[51] Int. Cl.[2] ..... E05C 3/26

[52] U.S. Cl. ..... 292/217; 292/DIG. 49

[58] Field of Search ..... 292/DIG. 49, 217, 201, 292/223, 225; 105/251

[56] References Cited

U.S. PATENT DOCUMENTS

| | | | |
|---|---|---|---|
| 2,901,985 | 9/1959 | Dorey | 292/238 X |
| 3,628,817 | 12/1971 | Sheahan | 292/DIG. 49 |
| 3,924,884 | 12/1975 | Christie | 292/DIG. 49 |

FOREIGN PATENT DOCUMENTS

| | | | |
|---|---|---|---|
| 1143736 | 2/1963 | Fed. Rep. of Germany | 292/223 |
| 607548 | 8/1960 | Italy | 292/223 |

*Primary Examiner*—Richard E. Moore
*Attorney, Agent, or Firm*—Thomas G. Anderson

[57] ABSTRACT

A door and discharge hopper combination including a locking mechanism which includes a rotatable latch jaw adapted to engage a keeper on the hopper door. The jaw is maintained in a locked position by means of a link and bell crank lever arrangement which is adapted to be biased into an over-center position to assure positive locking of the latch jaw and keeper arrangement.

10 Claims, 2 Drawing Figures

DOOR LOCKING MECHANISMS FOR HOPPERS

BACKGROUND OF THE INVENTION

The invention relates broadly to hopper structures having discharge gates or doors for regulating the discharge of the materials from the hopper structure. More specifically the invention relates to an improved locking mechanism which will securely lock the hopper door in a closed position and which can easily be manipulated to an open position for discharging materials.

SUMMARY OF THE INVENTION

The present invention is particularly applicable to railway hopper cars having hoppers arranged to discharge materials outwardly down slope sheets disposed on opposite sides of a center sill. Doors for closing the discharge openings of the hoppers are generally supported in hinged fashion on the side sills of the hopper structure or car so that they will swing downwardly and outwardly by gravity to their open position. The doors of the present invention include a keeper consisting of a pair of horizontally spaced ears 25 supporting therebetween a keeper bar or rod 26. In the closed position of the door, the keeper bar 26 is disposed within a socket 32 of a jaw 31 which forms part of a rotatable latch 30 which, upon rotation from a closed position to an open position, permits the disengagement of the keeper rod 26, thus allowing the door to open by gravity. The jaw 31 of the latch 30 is pivoted by means of a link 35 and bell crank structure 36. The bell crank structure 36 is adapted to move the pivotal connection 38 of the link 35 to a past-center or over-center position relative to a generally horizontal plane extending through the pivot 34 of the latch 30 and the pivot 37 of the bell crank 36. In the over-center position of the pivot 38 of the bell crank 36 the latch 30 is securely locked. Upon movement of a toggle linkage 40 and 42 the bell crank 36 may be moved from a spring-biased over-center closed position to an open position whereupon the rod 26 and jaw 31 are disengaged to permit the opening of the door and dumping of the load.

DESCRIPTION OF THE PREFERRED EMBODIMENT

Figure 1:
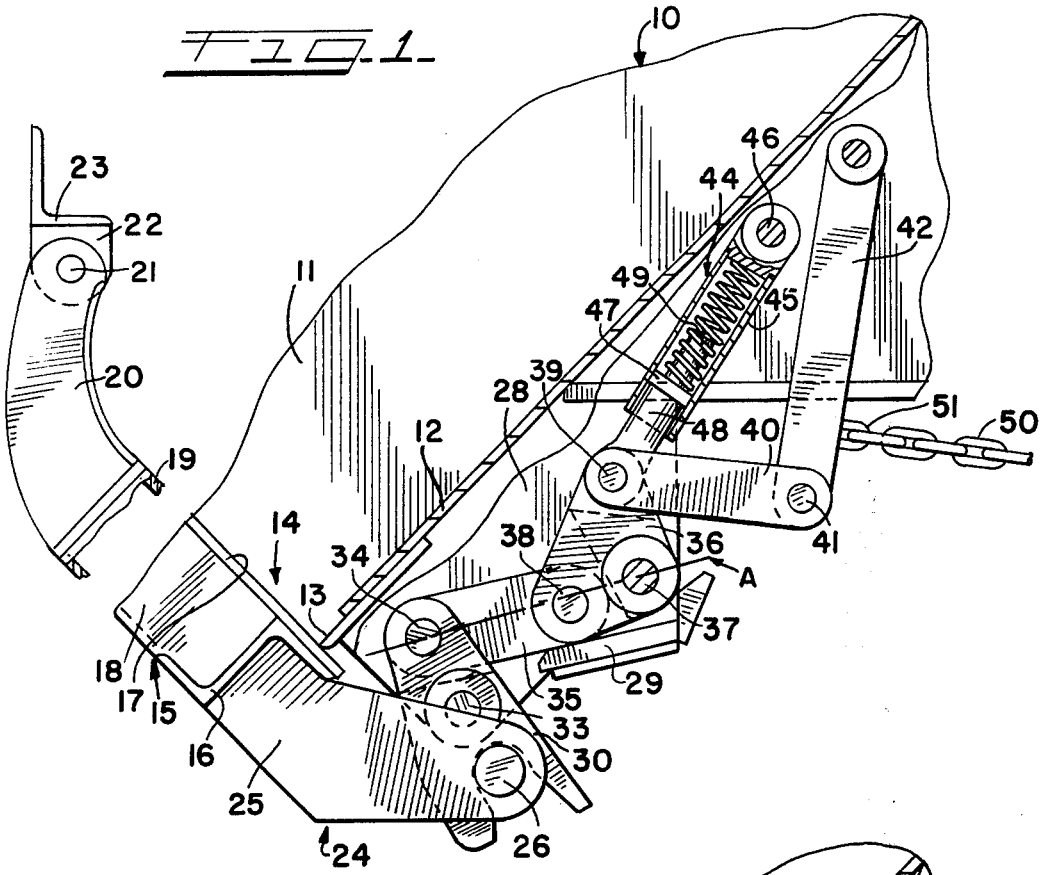
FIG. 1 is a cross-sectional view of a hopper structure and door arrangement including a lock for locking the door in a closed position and for releasing the same.
Figure 2:
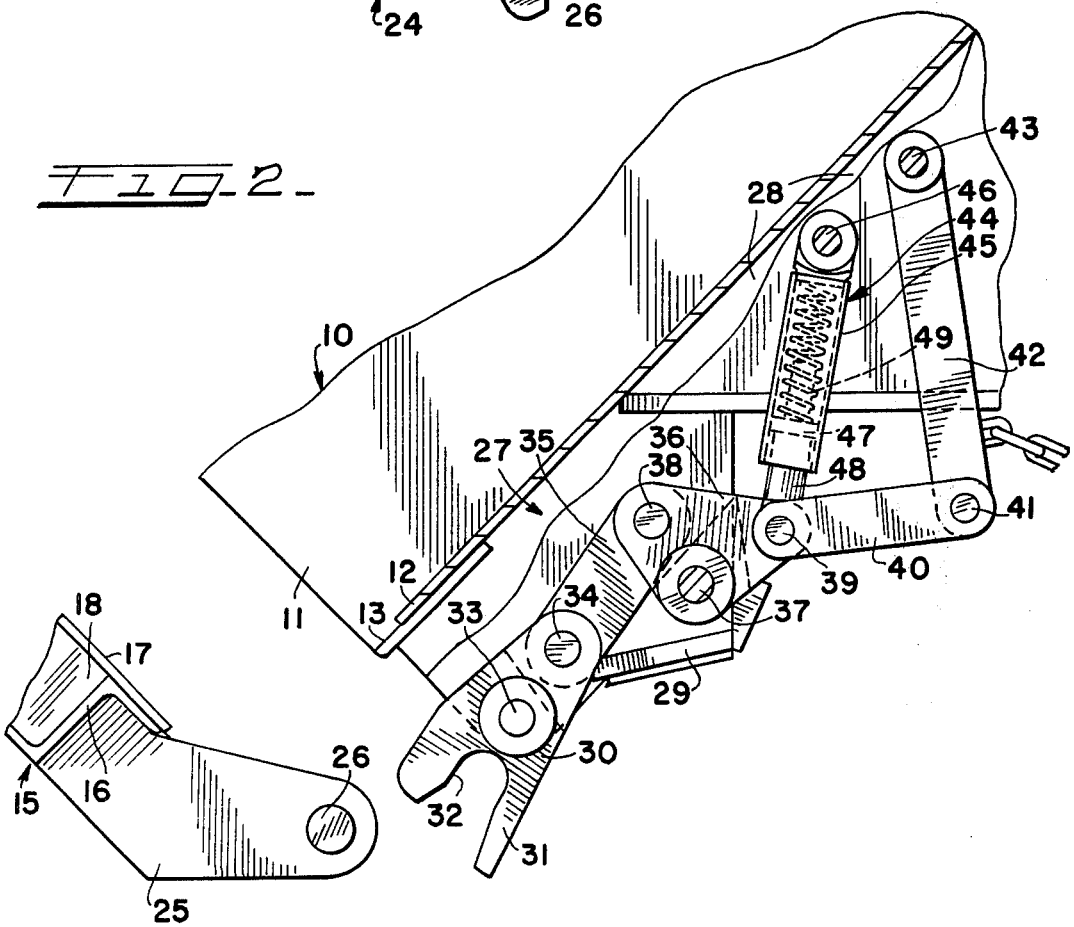
FIG. 2 is a view similar to FIG. 1 showing a hopper door and lock arrangement in a disengaging and opening position.

FIGS. 1 and 2 of the drawing show a hopper structure generally designated by the reference character 10 which includes a plurality of side sheets and a bottom diagonal or slope sheet or wall 12. The present hopper structure 10 may comprise parts of a railway hopper car and the discharge of materials from hopper structures of this type is usually downward and laterally outward of the car with the hoppers on each side thereof separated by a longitudinally extending center sill (not shown).

The lower portion of the slope sheet 12 has an edging plate 13 connected thereto which defines a discharge opening 14 through which the material of the hopper is to be discharged. A closure door 15 includes a lower Z-shaped reinforcing member 16 suitably connected to one end of a door panel 17. The door panel 17 is reinforced by a plurality of longitudinally spaced laterally extending stiffener members 18 which are connected to an upper reinforcing longitudinal channel 19 in conventional fashion. The connection of the door 15 to the hopper structure is not disclosed in detail but includes hinge elements 20 on the door 15 which by means of pivot pins or hinge members connect to pivot ears 22 in turn supported on side sills 23 which may be part of the hopper car or hopper structure.

A keeper generally designated at 24 is provided for each lock and includes horizontally spaced pivot ears 25 between which a keeper bar or rod 26 is supported. The underneath surface of the hopper structure 10 and sloping wall 12 has connected thereto a suitable bracket structure 27 which comprises a pair of longitudinally spaced vertical plates 28 which at their lower most extensions are provided with a stop ledge 29.

A locking mechanism includes a latch element 30 having at its foremost end a jaw portion 31 including a socket 32. The latch element 30 is pivoted by means of a pivot pin 33 about a first horizontal axis. A second pivot pin 34 connects the other end of the latch element 30 about a second horizontal axis to a link 35. The link 35 in turn is connected to a bell crank lever 36 which is supported by means of a pivot pin 37 connected to the vertical plates 28 whereupon the bell crank lever 36 is pivoted about a third horizontal axis. The first, second and third horizontal axes aforementioned are laterally spaced relative to each other and are substantially parallel with respect thereto. The bell crank lever 36 is also pivotally connected to the link 35 by pivot pin means 38 for pivotal movement about a fourth horizontal and parallel axis. A pivot pin 39 connects the remaining end of the bell crank lever 36 about a fifth horizontal axis 39 to a toggle link 40 which in turn is connected by means of a pivot means 41 to a toggle lever 42. The toggle lever 42 is pivotally connected by pivot means 43 to the plates 28 of the bracket 27.

As best shown in FIG. 1, a spring mechanism 44 includes a tubular casing 45 which is pivotally connected as indicated at pivot 46 to the plates 28 of the bracket 27. A piston member 47 is slideably disposed within the casing 45 and is connected to a piston rod 48, in turn connected to the fifth pivot axis by the pivot pin means 39. A spiral spring 49 exerts an outwardly directed force against the piston 47 thereby urging the bell crank 36 to a closed position. As best shown in FIG. 1, the pivot axis 38 is then in a past-center or over-center position with respect to a plane extending through the axes 34 and 37 as designated by the letter A. A chain 50 may be connected to the toggle lever 42 which may be utilized for actuating the lock mechanism to an open position.

OPERATION

The closed position is shown in FIG. 1 wherein the keeper rod 26 is in locking engagement with respect to the jaw 31 of latch 30, and the latch 30 is positioned to exert an inwardly directed force against the keeper rod 26 to effectively maintain the door 15 is a closed position. The pivot means 38 is disposed in a past-center or over-center position, with the bell crank lever 36 seated against the stop 29 to maintain the set position wherein the latch member 30 is an over-center lock. This position is maintained by the biasing action of the spring arrangement 44 which urges and maintains the bell crank lever 36 in the over-center lock position.

When the hopper has reached its destination on a railway car and is ready to be dumped, the operator adjacent to the track merely pulls on the chain 50 which thereby causes the toggle links 42 and 40 to move the bell crank lever 36 against the action of the spring mechanism 44 to the position shown in FIG. 2. The jaw 31 is now in a position that the keeper rod 26 is quickly and easily disengaged therefrom as gravity swings door 15 outward, and the load is thereupon discharged. After discharge of the load the operator merely causes the door 15 to swing into engagement with the open jaw 31 as shown in FIG. 2, whereupon the force of the swinging door causes movement of latch member 30, link 35, bell crank 36 and other structure to again assume the locked position shown in FIG. 1. By virtue of the combination of the aforementioned elements, the hopper door 15 will again be securely locked and will maintain the set position until discharge is again initiated.

What is claimed is:

1. For a hopper structure having a sloped bottom wall terminating at a lower end in a discharge opening;

said hopper structure including a door hingedly connected thereto for swinging movement between open and closed positions relative to said discharge opening, the improvement of a locking mechanism comprising:

a keeper element on said door, a bracket on said hopper connected to said sloping bottom wall, a latch member having first and second ends, including a keeper receiving jaw at said first end thereof, means mounting said latch member on said bracket for pivotal movement about a first horizontal axis, a first link connected to said second end of said latch member for pivotal movement about a second horizontal axis parallel to and spaced from said first axis, a bell crank lever mounted on said bracket for pivotal movement about a third horizontal axis spaced laterally from and being parallel to said second axis, pivot means connecting said first link to said bell crank lever for movement about a fourth horizontal axis parallel to and spaced from said third axis, a first toggle lever connected to said bell crank for pivotal movement about a fifth horizontal axis parallel to said fourth axis, a second toggle lever pivotally connected to said first toggle lever, biasing means connected to said bell crank lever urging said pivot means of said first link and fourth horizontal axis to an over-center position relative to a generally horizontal plane extending through said second and third horizontal axes wherein said keeper receiving jaw is in locking engagement with said keeper element to maintain said door in a closed position.

2. The invention in accordance with claim 1, including second pivot means for connecting said second toggle lever to said bracket.

3. The invention in accordance with claim 2, including means connected to said toggle levers for exerting a pulling force thereon for moving said bell crank lever from its over-center position and thereby moving said latch and jaw out of engagement with said keeper element.

4. The invention in accordance with claim 1, said biasing means including spring means connected at one end to said bell crank lever at said fifth axis.

5. The invention in accordance with claim 4, including means pivotally connecting said other end of said spring means to said bracket.

6. The invention in accordance with claim 5, said biasing means including a tubular housing captivating said spring means, and a piston within said housing being urged outwardly thereof by said spring means.

7. The invention in accordance with claim 1, said latch member in said locked over-center position exerting a force on said keeper element to wedge said door against said bottom wall.

8. The invention in accordance with claim 7, said jaw providing a socket, and said keeper element having a bar-like configuration secured within said socket.

9. The invention in accordance with claim 1, including means limiting the under-center movement of said bell crank lever.

10. The invention in accordance with claim 9, said limiting means comprising a stop on said bracket disposed below said bell crank lever.

* * * * *